US012539992B2

(12) United States Patent
Mustonen

(10) Patent No.: US 12,539,992 B2
(45) Date of Patent: Feb. 3, 2026

(54) STRETCH-WRAPPING MACHINE WITH PRE-STRETCH ROLLERS

(71) Applicant: Signode Industrial Group LLC, Tampa, FL (US)

(72) Inventor: Pekka Mustonen, Turku (FI)

(73) Assignee: Signode Industrial Group LLC, Tampa, FL (US)

( * ) Notice: Subject to any disclaimer, the term of this patent is extended or adjusted under 35 U.S.C. 154(b) by 0 days.

(21) Appl. No.: 18/864,766

(22) PCT Filed: May 30, 2023

(86) PCT No.: PCT/US2023/067608

§ 371 (c)(1),
(2) Date: Nov. 11, 2024

(87) PCT Pub. No.: WO2023/235698

PCT Pub. Date: Dec. 7, 2023

(65) Prior Publication Data

US 2025/0313361 A1 Oct. 9, 2025

Related U.S. Application Data

(60) Provisional application No. 63/365,795, filed on Jun. 3, 2022.

(51) Int. Cl.
*B65B 11/02* (2006.01)

(52) U.S. Cl.
CPC ..... *B65B 11/025* (2013.01); *B65B 2210/14* (2013.01)

(58) Field of Classification Search
USPC ..... 53/397
See application file for complete search history.

(56) References Cited

U.S. PATENT DOCUMENTS

| | | | |
|---|---|---|---|
| 3,589,095 | A | 6/1971 | James et al. |
| 3,650,773 | A | 3/1972 | Bush et al. |
| 4,458,467 | A | 7/1984 | Shulman et al. |
| 4,628,668 | A | 12/1986 | Wildmoser |
| 4,655,028 | A | 4/1987 | Silbernagel |
| 4,706,443 | A | 11/1987 | Humphrey |

(Continued)

FOREIGN PATENT DOCUMENTS

| | | | |
|---|---|---|---|
| CN | 106516219 | A | 3/2017 |
| CN | 206345042 | U | 7/2017 |

(Continued)

OTHER PUBLICATIONS

"International Search Report and Written Opinion", from corresponding PCT patent application No. PCT/US2023/067608, Oct. 25, 2023.

(Continued)

*Primary Examiner* — Chinyere J Rushing-Tucker
(74) *Attorney, Agent, or Firm* — Neal, Gerber & Eisenberg LLP

(57) ABSTRACT

Various embodiments of the present disclosure provide a stretch-wrapping machine with at least three pre-stretch rollers sized, positioned, and otherwise configured to minimize necking and slippage as the film is drawn through and stretched by the pre-stretch rollers before the film is applied to the load.

30 Claims, 6 Drawing Sheets

(56) References Cited

U.S. PATENT DOCUMENTS

| | | | |
|---|---|---|---|
| 5,311,725 | A | 5/1994 | Martin et al. |
| 5,414,979 | A | 5/1995 | Moore et al. |
| 5,423,163 | A | 6/1995 | Wendt |
| 5,491,956 | A | 2/1996 | Donnelly et al. |
| 5,517,807 | A | 5/1996 | Morantz |
| 5,606,849 | A | 3/1997 | Bettenhausen |
| 5,628,167 | A | 5/1997 | Huson et al. |
| 5,794,418 | A | 8/1998 | Lai |
| 5,797,240 | A | 8/1998 | Martin-Cocher et al. |
| 5,836,140 | A | 11/1998 | Lancaster |
| 5,875,616 | A | 3/1999 | Paavola et al. |
| 5,979,146 | A | 11/1999 | Orpen et al. |
| 6,082,081 | A | 7/2000 | Mucha |
| 6,219,992 | B1 | 4/2001 | Maeki-Rahkola et al. |
| 6,253,532 | B1 | 7/2001 | Orpen |
| 6,305,145 | B2 | 10/2001 | Suolahti |
| 6,360,512 | B1 | 3/2002 | Marois et al. |
| 6,393,808 | B1 | 5/2002 | Kallner et al. |
| 6,453,643 | B1 | 9/2002 | Buscherini et al. |
| 6,694,712 | B2 | 2/2004 | Suolahti |
| 6,713,010 | B1 * | 3/2004 | Doran ..... B65B 67/085 264/289.6 |
| 6,748,718 | B2 | 6/2004 | Lancaster et al. |
| 6,874,297 | B2 | 4/2005 | Solis et al. |
| 6,910,315 | B2 | 6/2005 | Suolahti |
| 7,107,743 | B2 | 9/2006 | Suolahti |
| 7,178,317 | B1 | 2/2007 | Koskela |
| 7,533,515 | B1 | 5/2009 | Koskela |
| 7,707,802 | B2 | 5/2010 | Forrest |
| 8,001,745 | B2 | 8/2011 | Carter et al. |
| 8,453,420 | B2 | 6/2013 | Schmidt et al. |
| 10,960,998 | B2 | 3/2021 | Nicholson |
| 11,110,645 | B2 | 9/2021 | Bowden |
| 11,518,561 | B2 | 12/2022 | Martin |
| 11,814,205 | B2 | 11/2023 | Lancaster et al. |
| 2005/0178084 | A1 | 8/2005 | Haloila |
| 2007/0204565 | A1 | 9/2007 | Lancaster et al. |
| 2010/0263331 | A1 | 10/2010 | Paavola et al. |
| 2020/0231312 | A1 | 7/2020 | Cere' |
| 2020/0299010 | A1 | 9/2020 | Lancaster et al. |
| 2021/0039815 | A1 * | 2/2021 | Martin ..... B65B 11/025 |
| 2021/0309401 | A1 | 10/2021 | Lopes |

FOREIGN PATENT DOCUMENTS

| | | | |
|---|---|---|---|
| CN | 214298507 | U | 9/2021 |
| DE | 4234604 | A1 | 4/1994 |
| EP | 0621184 | A1 | 10/1994 |
| EP | 1188671 | A1 | 3/2002 |
| EP | 1213223 | A1 | 6/2002 |
| EP | 3795481 | A1 | 3/2021 |
| EP | 4316995 | A1 | 2/2024 |
| EP | 4428046 | A1 | 9/2024 |
| FR | 3092831 | A1 | 8/2020 |
| JP | H046012 | A | 1/1992 |
| KR | 20170062147 | A | 6/2017 |
| WO | 2007010341 | A1 | 1/2007 |
| WO | 2008115865 | A1 | 9/2008 |
| WO | 2015082945 | A1 | 6/2015 |
| WO | 2015192250 | A1 | 12/2015 |
| WO | 2021178189 | A1 | 9/2021 |
| WO | 2023002404 | A1 | 1/2023 |
| WO | 2023007353 | A1 | 2/2023 |
| WO | 2024003765 | A1 | 1/2024 |
| WO | 2024003852 | A1 | 1/2024 |

OTHER PUBLICATIONS

Notification of Reasons for Rejection, with English translation from corresponding Japanese Patent Application No. 2024-571012, Oct. 28, 2025.

* cited by examiner

STRETCH-WRAPPING MACHINE WITH PRE-STRETCH ROLLERS

PRIORITY

This application is a national phase application of PCT/US2023/067608, filed on May 30, 2023, which claims priority to and the benefit of U.S. Provisional Patent Application No. 63/365,795, filed Jun. 3, 2022, the entire contents of which is incorporated herein by refer-ence.

FIELD

The present disclosure relates to stretch-wrapping machines, and more particularly to stretch-wrapping machines that include pre-stretch rollers.

BACKGROUND

Several types of known stretch-wrapping machines use stretch film to secure loads of goods on pallets. These stretch-wrapping machines include a film carriage to which a replaceable roll of stretch film is mounted. Depending on the type of stretch-wrapping machine, the film carriage rotates relative to the palletized load or the palletized load rotates relative to the film carriage while the film carriage vertically moves relative to the load to wrap the load with the stretch film in a spiral pattern. For instance, a turntable wrapping machine rotates a turntable carrying the palletized load while vertically moving the film carriage to wrap the load with the stretch film. A ring wrapping machine rotates the film carriage on a circular ring that circumscribes the palletized load while vertically moving the film carriage to wrap the load with the stretch film. A rotating arm wrapping machine rotates a cantilevered arm carrying the film carriage around the palletized load while vertically moving the film carriage to wrap the load with the stretch film.

Certain stretch-wrapping machines include pre-stretch assemblies that pre-stretch the film along its longitudinal axis after it is pulled off of the film roll and before it is applied to the load. Pre-stretching the film before applying it to the load has several benefits, including increasing the film's containment force and extending the longevity of the film roll. One known pre-stretch assembly includes an upstream pre-stretch roller, a downstream pre-stretch roller, and a pre-stretch drive assembly operably connected to the upstream and downstream pre-stretch rollers to rotate them. The downstream pre-stretch roller has a diameter that is double the diameter of the upstream pre-stretch roller. The pre-stretch drive assembly drives the rollers so the downstream pre-stretch roller has a higher linear speed than the upstream pre-stretch roller. The linear speed (alternatively called the tangential speed) of a roller is a function of its diameter and its rotational speed and corresponds to the speed of the film contacting the roller. This linear speed differential results in the downstream pre-stretch roller imposing a stretching force on the film, resulting in the film stretching after it disengages the upstream pre-stretch roller and travels onto the downstream pre-stretch roller. The difference in the diameters of the pre-stretch rollers enables the pre-stretch assembly to achieve a relatively high pre-stretch.

One problem with this known pre-stretch assembly is that the effective surface area of the downstream pre-stretch roller is double that of the upstream pre-stretch roller. As used herein, the "effective surface area" of a roller means the surface area of the roller in contact with the film at a given point in time. As the effective surface area of the downstream pre-stretch roller increases relative to the effective surface area of the upstream pre-stretch roller, the likelihood that the film will slip over the upstream pre-stretch roller increases, particularly when using low-quality film. When slippage occurs, the upstream pre-stretch roller effectively "releases" the film and the film slides over the upstream pre-stretch roller rather than traveling with the roller as it rotates, resulting in little to no stretch and defeating the purpose of the pre-stretch assembly.

Although pre-stretching the film has several benefits, one downside is necking. Necking (also known as neckdown) refers to the narrowing of the film's width that occurs as the film is pre-stretched—the more the film is pre-stretched, the more pronounced the necking (e.g., film pre-stretched at 190% will exhibit more necking than film pre-stretched at 150%). An exaggerated example of the necking phenomenon is shown in FIG. 1. In this example, when a stretching force is applied to a film web FW pulled off of a film roll R, the film web FW stretches longitudinally but narrows in width from a first width $W_1$ to a second width $W_2$. A narrower film web results in more film needed to adequately wrap the load, which partially offsets a benefit of pre-stretching. There is a continuing need to achieve the desired pre-stretch while minimize necking to maximize film usage.

SUMMARY

Various embodiments of the present disclosure provide a stretch-wrapping machine including at least three pre-stretch rollers sized, positioned, and otherwise configured to minimize necking and slippage as the film is drawn through and stretched by the pre-stretch rollers before the film is applied to the load.

Various embodiments of the present disclosure provide a film carriage for a wrapping machine, wherein the film carriage includes: a film-carriage frame; a first pre-stretch roller having a first diameter and rotatably mounted to the film-carriage frame; a second pre-stretch roller having a second diameter and rotatably mounted to the film-carriage frame; and a third pre-stretch roller having a third diameter and rotatably mounted to the film-carriage frame, wherein the third diameter is greater than the first diameter and the second diameter.

Various embodiments of the present disclosure provide a wrapping machine including: a wrapping-machine frame; a guide mounted to the wrapping machine frame; a guide actuator operably connected to the guide to move the guide vertically relative to the wrapping-machine frame; and a wrapping assembly mounted to the guide and comprising a film carriage. The film carriage includes: a film-carriage frame; a first pre-stretch roller having a first diameter and rotatably mounted to the film-carriage frame; a second pre-stretch roller having a second diameter and rotatably mounted to the film-carriage frame; and a third pre-stretch roller having a third diameter and rotatably mounted to the film-carriage frame, wherein the third diameter is greater than the first diameter and the second diameter. The wrapping machine further includes a wrapping-assembly actuator operably connected to the wrapping assembly to move the wrapping assembly relative to the guide.

DETAILED DESCRIPTION

Figure 1:
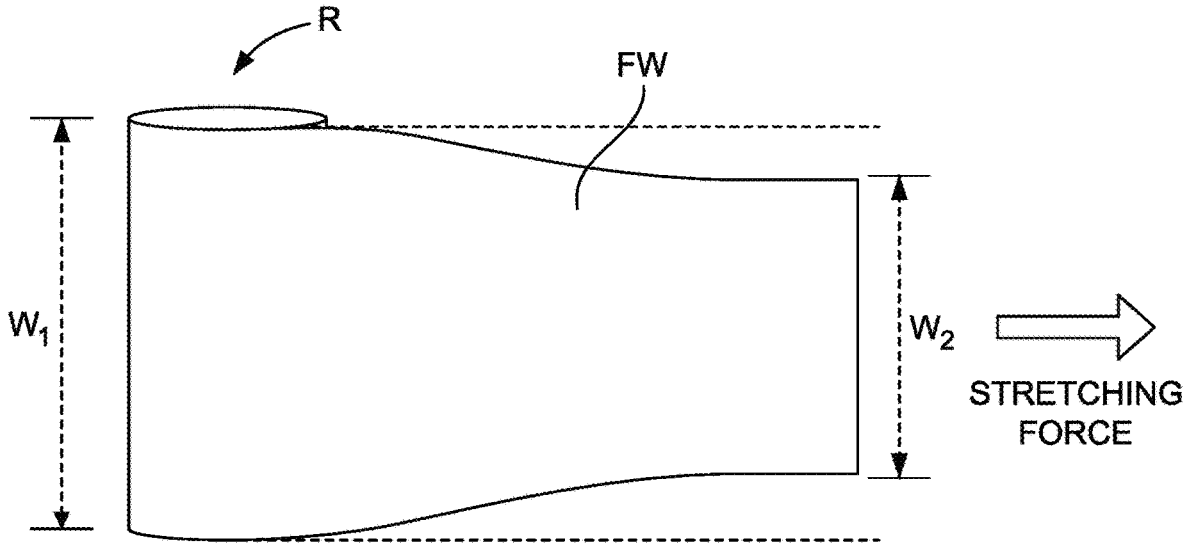
FIG. 1 shows necking of a film web as a stretching force is applied to stretch the film web.

While the systems, devices, and methods described herein may be embodied in various forms, the drawings show and the specification describes certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connections of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting methods, such as mounted, connected, etc., are not intended to be limited to direct mounting methods but should be interpreted broadly to include indirect and operably mounted, connected, and like mounting methods. This specification is intended to be taken as a whole and interpreted in accordance with the principles of the present disclosure and as understood by one of ordinary skill in the art.

Various embodiments of the present disclosure provide a stretch-wrapping machine with at least three pre-stretch rollers sized, positioned, oriented, and otherwise configured to minimize necking and slippage as the film is drawn through and stretched by the pre-stretch rollers before the film is applied to the load.

Figure 2:
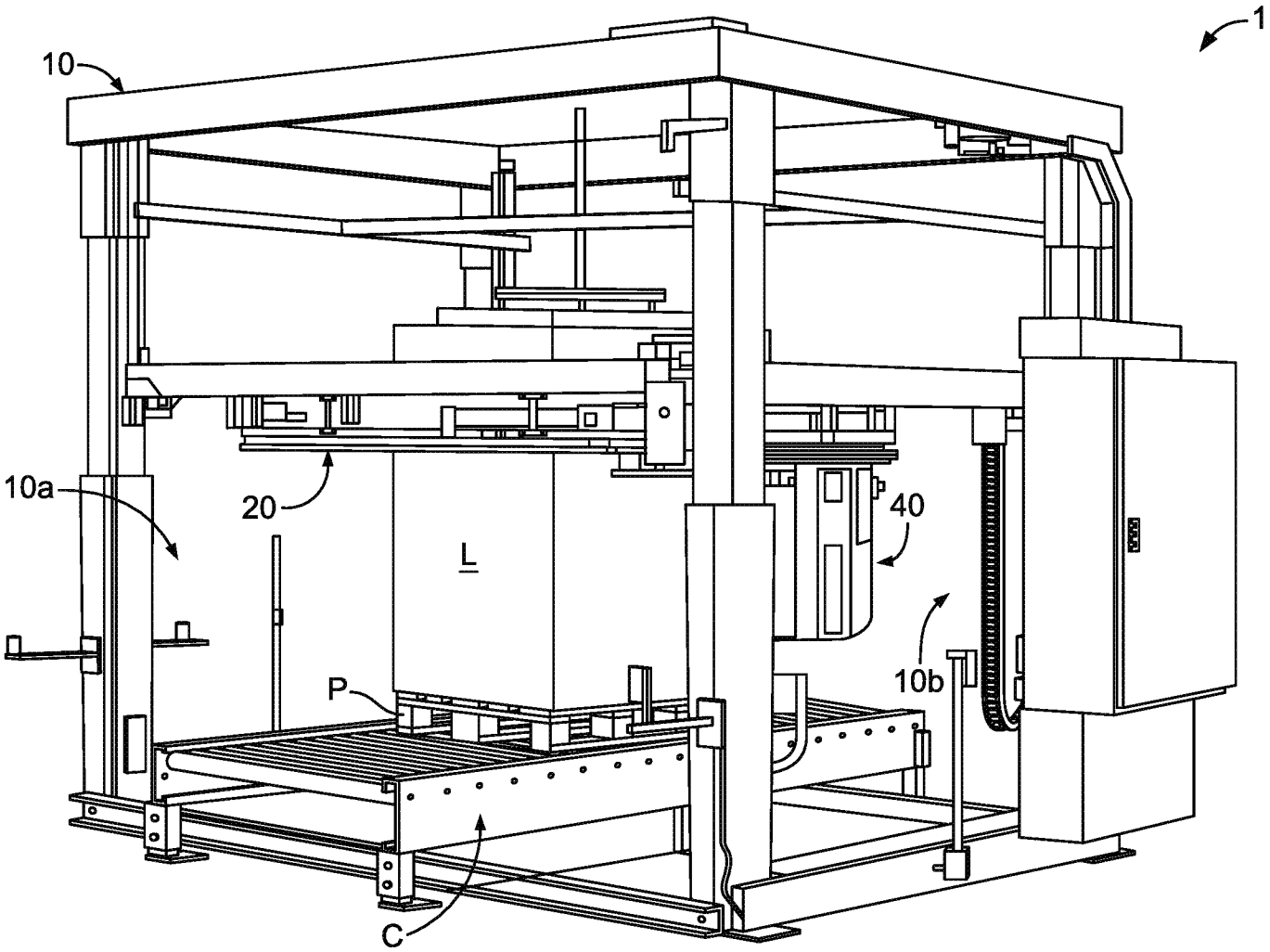
FIG. 2 is a perspective view of one example embodiment of a stretch-wrapping machine of the present disclosure.
Figure 3:
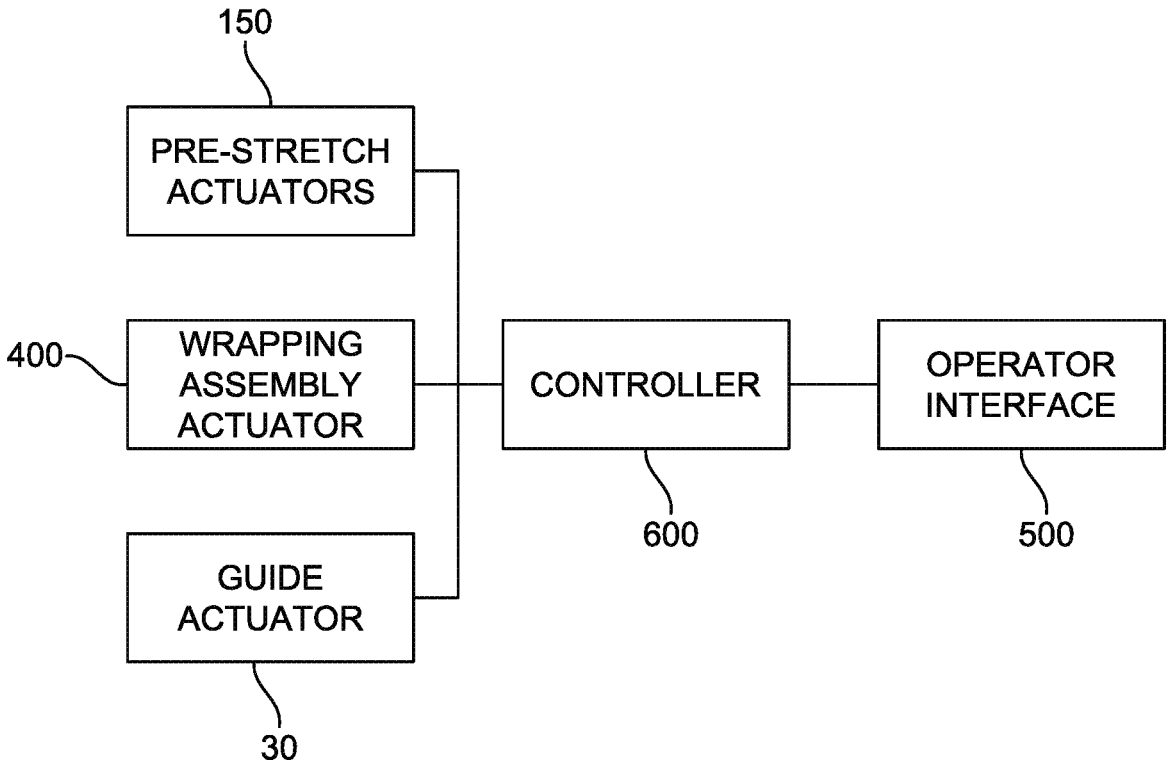
FIG. 3 is a block diagram showing certain components of the stretch-wrapping machine of FIG. 2.

FIGS. 2 and 3 show one embodiment of the stretch-wrapping machine 1 (sometimes referred to herein as the "wrapping machine" for brevity) of the present disclosure. The wrapping machine 1 includes a wrapping-machine frame 10, a circular guide 20, a guide actuator 30, a wrapping assembly 40, a cutting-and-fixing device (not shown), an operator interface 500, and a controller 600.

The wrapping-machine frame 10 is formed from multiple tubular and/or solid members (not individually labeled) and configured to support the other components of the wrapping machine 1. The wrapping-machine frame 10 defines a wrapping area within its interior and has an infeed area 10*a* at which a palletized load (such as a load L on a pallet P) is conveyed (such as via a conveyor C) into the wrapping area for wrapping and an outfeed area 10*b* at which the palletized load is conveyed (such as via the conveyor C) from the wrapping area after wrapping. The illustrated wrapping-machine frame 10 is merely one example configuration, and any suitable configuration can be employed.

The circular guide 20 serves as the mount for the wrapping assembly 40 and is movably mounted to the wrapping-machine frame 10 (such as to one or more vertical members of the wrapping-machine frame 10) such that the circular guide 20 is vertically movable relative to the wrapping-machine frame 10 between an upper position and a lower position.

The guide actuator 30 is operably connected to the circular guide 20 to move the circular guide 20 relative to the wrapping-machine frame 10 between the upper and lower positions. In certain embodiments, the guide actuator 30 includes one or more motors operably connected to the circular guide 20 via one or more belt-and-pulley assemblies to move the circular guide 20 between the upper and lower positions. In other embodiments, the guide actuator 30 includes one or more pneumatic or hydraulic cylinders operably connected to the circular guide 20 to move the circular guide 20 between the upper and lower positions. These are merely examples, and the guide actuator 30 can include any suitable actuator configured to move the circular guide 20 between the upper and lower positions.

The wrapping assembly 40 is movably mounted to the circular guide 20 such that the wrapping assembly 40 is rotatable relative to the circular guide 20. The wrapping assembly 40 includes a ring-shaped support (not shown), a film carriage 100 (FIG. 4), and a wrapping-assembly actuator 400 (FIG. 3).

The ring-shaped support serves as the mount for the film carriage 100 and is movably mounted to the circular guide 20 such that the support (and the film carriage 100 and other components connected to the support) is rotatable relative to the circular guide 20. In this example embodiment, the support is movably mounted to the circular guide 20 via multiple spaced-apart rollers (not shown) that are connected to the support and positioned on a track (not shown) on the circular guide 20.

Figure 4:
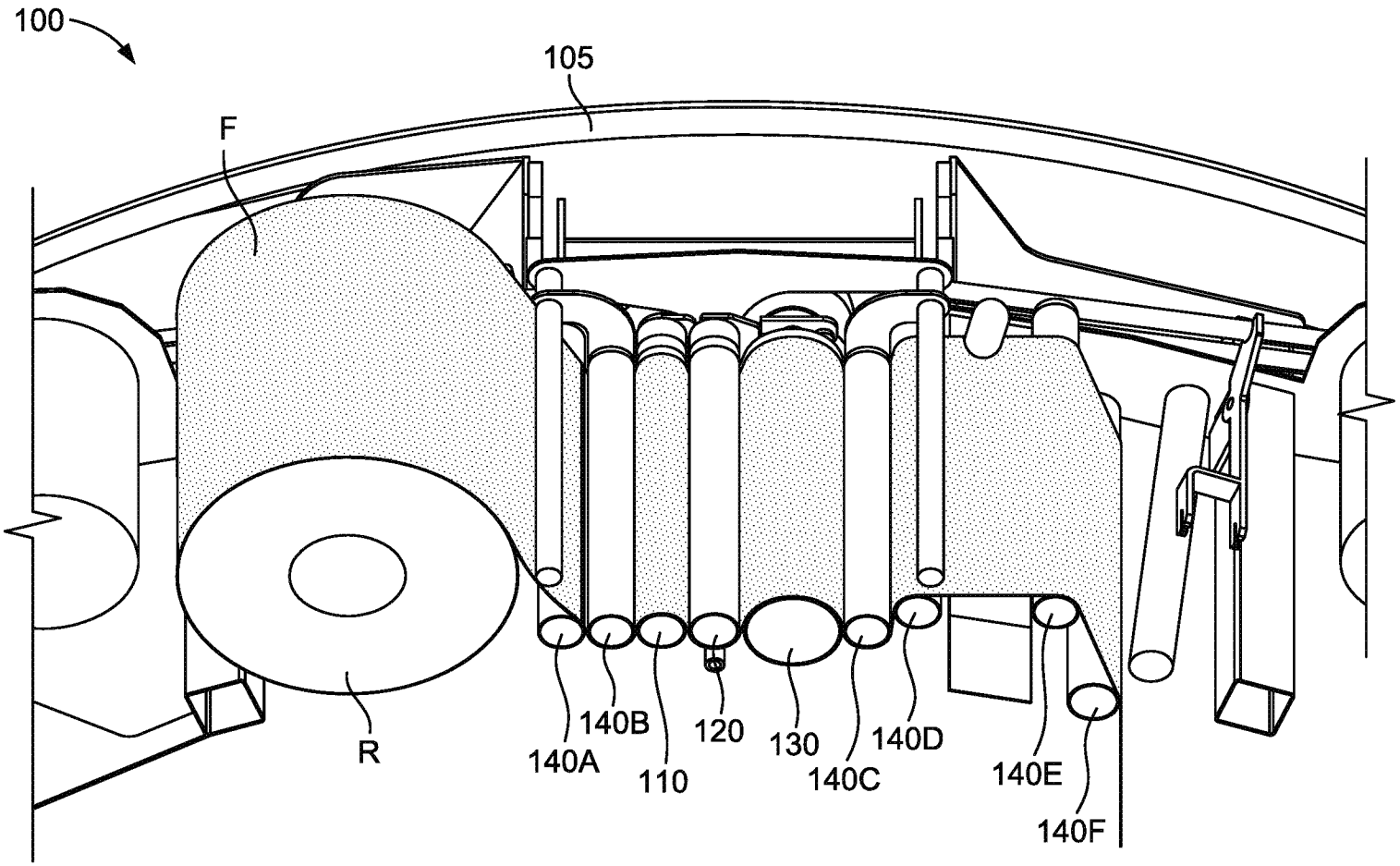
FIG. 4 is a perspective view of part of the film carriage of the wrapping assembly of the stretch-wrapping machine of FIG. 2.

The film carriage 100 is fixedly connected to the support to move with the support (i.e., rotate relative to the circular guide 20 and move vertically relative to the wrapping-machine frame 10). As shown in FIG. 4, the film carriage 100 is configured to rotatably support a replaceable roll R of film F (such as plastic stretch film), pre-stretch the film F after pulling it from the roll R, and apply the pre-stretched film to the load as the film carriage 100 rotates around the load. The film carriage 100 includes a film-carriage frame 105; film-reel supports (not labeled); a pre-stretch assembly including a first pre-stretch roller 110, a second pre-stretch roller 120, a third pre-stretch roller 130, a pre-stretch drive assembly (not shown); and a plurality of idler rollers 140A, 140B, 140C, 140D, 140E, and 140F.

The film-carriage frame 105 is formed from multiple tubular and/or solid members (not individually labeled) and configured to support the other components of the film carriage 100. The illustrated film-carriage frame 105 is merely one example configuration, and any suitable configuration can be employed.

The film-reel supports are mounted near one end of the film-carriage frame 105 so the roll R of film F can be rotatably mounted to the film-reel supports. The idler rollers 140A, 140B, 140C, 140D, 140E, and 140F and the pre-stretch assembly are mounted to or otherwise supported by the film-carriage frame 105. The first idler roller 140A is rotatably mounted (such as via bearings) to the film-carriage frame 105 downstream of the film-reel supports so the first idler roller 140A can freely rotate relative to the film-carriage frame 105 about a rotational axis. As used herein, "downstream" means the direction of travel of the film F as the film is pulled off the roll R and "upstream" means the direction opposite the direction of travel of the film F as the film is pulled off the roll R. The second idler roller 140B is rotatably mounted (such as via bearings) to the film carriage frame 105 downstream of the first idler roller 140A so the second idler roller 140B can freely rotate relative to the film-carriage frame 105 about a rotational axis. A slight gap (not labeled) exists between the first and second idler rollers 140A and 140B to enable the film F to pass between them.

The first pre-stretch roller 110 has a first diameter D1 and is rotatably mounted (such as via bearings and/or components of the pre-stretch drive assembly) to the film-carriage frame 105 downstream of the second idler roller 140B so the first pre-stretch roller 110 can rotate relative to the film-carriage frame 105 (and under control of the pre-stretch drive assembly). The outer surface of the first pre-stretch roller 110 can have a high-friction coating applied. The second idler roller 140B can be spring biased to press against the first pre-stretch roller 110, and a slight gap (not labeled) can exist between the second idler roller 140B and the first pre-stretch roller 110 to enable the film F to pass between them. When no film passes between the second idler roller 140B and the first pre-stretch roller 110, the spring biased second idler roller 140B can engage the first pre-stretch roller 110, thus closing this slight gap.

The second pre-stretch roller 120 has a second diameter D2 and is rotatably mounted (such as via bearings and/or components of the pre-stretch drive assembly) to the film-carriage frame 105 downstream of the first pre-stretch roller 110 so the second pre-stretch roller 120 can rotate relative to the film-carriage frame 105 (and under control of the pre-stretch drive assembly). The outer surface of the second pre-stretch roller 120 can have a high-friction coating applied. A slight gap (not labeled) exists between the first and second pre-stretch rollers 110 and 120 to enable the film F to pass between them. In this example embodiment, the first diameter D1 and the second diameter D2 are substantially the same.

The third pre-stretch roller 130 has a third diameter D3 and is rotatably mounted (such as via bearings and/or components of the pre-stretch drive assembly) to the film-carriage frame 105 downstream of the second pre-stretch roller 120 so the third pre-stretch roller 130 can rotate relative to the film-carriage frame 105 (and under control of the pre-stretch drive assembly). The outer surface of the third pre-stretch roller 130 can have a high-friction coating applied. A slight gap (not labeled) exists between the second and third pre-stretch rollers 120 and 130 to enable the film F to pass between them. The third diameter D3 is greater than (and in this particular example, about 2×) each of the first and second diameters D1 and D2.

The third idler roller 140C is rotatably mounted (such as via bearings) to the film carriage frame 105 downstream of the third pre-stretch roller 130 so the third idler roller 140C can freely rotate relative to the film-carriage frame 105 about a rotational axis. The third idler roller 140C can be spring biased to press against the third pre-stretch roller 130, and a slight gap (not labeled) can exist between the third pre-stretch roller 130 and the third idler roller 140C to enable the film F to pass between them. When no film passes between the third idler roller 140C and the third pre-stretch roller 130, the spring biased third idler roller 140C can engage the third pre-stretch roller 130, thus closing this slight gap.

The fourth idler roller 140D is rotatably mounted (such as via bearings) to the film carriage frame 105 downstream of the third idler roller 140C so the fourth idler roller 140D can freely rotate relative to the film-carriage frame 105 about a rotational axis. A slight gap (not labeled) exists between the third idler roller 140C and the fourth idler roller 140D to enable the film F to pass between them.

The fifth and sixth idler rollers 140E and 140F are rotatably mounted (such as via bearings) to the film-carriage frame 105 downstream of the fourth idler roller 140D so they can each freely rotate relative to the film-carriage frame 105.

As shown in FIG. 4, the film F extends from the roll R, passes between the first and second idler rollers 140A and 140B, partially around the second idler roller 140B, and contacts the first pre-stretch roller 110. The film F passes partially around the first pre-stretch roller 110, onto and partially around the second pre-stretch roller 120. The film F passes partially around the second pre-stretch roller 120, onto and partially around the third pre-stretch roller 130. The film F then passes partially around the third pre-stretch roller 130 and onto and partially around each of the third idler roller 140C, the fourth idler roller 140D, the fifth idler roller 140E, and the sixth idler roller 140F, before exiting the film carriage 100 and contacting the load L. The film F thus winds in a serpentine manner around rollers 140A, 140B, 110, 120, 130, 140C, and 140D, before contacting rollers 140E and 140F, so: (1) a first surface of the film F contacts the first idler roller 140A, the first pre-stretch roller 110, the third pre-stretch roller 130, the fourth idler roller 140D, the fifth idler roller 140E, and the sixth idler roller 140F; and (2) a second surface of the film F opposite the first surface contacts the second idler roller 140B, the second pre-stretch roller 120, and the third idler roller 140C.

The pre-stretch drive assembly is operably connected to the pre-stretch rollers 110, 120, and 130 and configured to drive the pre-stretch rollers so they stretch the film F as it travels between the pre-stretch rollers. The pre-stretch drive assembly includes one or more pre-stretch actuators 150 operably connected to the pre-stretch rollers 110, 120, and 130 via one or more drive trains (not shown). The pre-stretch actuators 150 include electric motors in this example embodiment, though they can be any suitable actuators in other embodiments. The one or more drive trains include several components, such as gears, gear pulleys, belts, and the like, that convert the output of the pre-stretch actuators 150 into rotation of the first, second, and third pre-stretch rollers 110, 120, and 130 at different linear speeds to pre-stretch the film F, as described below.

The linear speed at the outer surface of a given pre-stretch roller, which corresponds to the speed of film when contacting the roller, is a function of the diameter and the rotational speed of the roller. For instance, two rollers having the same diameter and rotating at the same rotational speed (e.g., the same number of rotations per minute) will have the same linear speed. Two rollers with different diameters and rotating at the same rotational speed will have different linear speeds: the linear speed of the larger-diameter roller will be greater than the linear speed of the smaller-diameter roller.

The pre-stretch drive assembly is operably connected to the pre-stretch rollers 110, 120, and 130 and configured to drive them at first, second, and third linear speeds, respectively. The third linear speed is greater than the second linear speed, and the second linear speed is greater than the first linear speed. This results in the pre-stretch drive assembly pre-stretching the film F in two stages: a first pre-stretch stage as the film F transitions from the first pre-stretch roller 110 to the second pre-stretch roller 120, and a second pre-stretch stage as the film F transitions from the second pre-stretch roller 120 to the third pre-stretch roller 130. The first, second, and third linear speeds of the first, second, and third pre-stretch rollers 110, 120, and 130 can be controlled such that 1-15% of the stretching of the film F occurs in the first pre-stretch stage between the first and second pre-stretch rollers 110 and 120, and such that 85-99% of the stretching of the film F occurs in the second pre-stretch between the second and third pre-stretch rollers 120 and 130. The third linear speed is selected based on the desired film-feeding speed for the particular load being wrapped. To achieve this ratio of stretching, the first linear speed is generally set at 15-95% of the third linear speed, and the second linear speed is set at 101%-150% of the first linear speed. Due to the fact that the third diameter D3 of the third pre-stretch roller 130 is greater than the first and second diameters D1 and D2 of the first and second pre-stretch rollers 110 and 120, the third pre-stretch roller 130 may not have the greatest rotational speed even though it has the greatest linear speed. As a result, the amount of pre-stretch can range from 10% to 400%, which corresponds to the percentage amount of additional length added to the film during the stretch. To explain using a non-limiting example, a 10% stretch corresponds to an increase in length from 10 feet to 11 feet (increasing the length by 10%), a 100% stretch corresponds to an increase in length from 10 feet to 20 feet (increasing the length by 100%), and a 400% stretch corresponds to an increase in length from 10 feet to 50 feet (increasing the length by 400%).

As used herein, the "critical distance" between two adjacent pre-stretch rollers means the distance over which film travels between those pre-stretch rollers while not in contact with those pre-stretch rollers. Put differently, the critical distance is generally equal to the length of a line extending between and tangent to both of two adjacent pre-stretch rollers. The critical distance is a function of the relative diameters of the rollers and the distance between the surfaces of the rollers (i.e., the length of a line normal to the surfaces of the rollers). Holding the diameters of two adjacent pre-stretch rollers constant, increasing the distance between the surface of the rollers increases the critical distance. Holding the distance between the surface of the rollers constant, increasing the diameter of one of the rollers increases the critical distance. Holding the distance between the surface of the rollers constant, increasing the diameters of both of the rollers increases the critical distance. The critical distance between two adjacent pre-stretch rollers directly affects the amount of necking experienced by film traveling from the upstream pre-stretch roller to the downstream pre-stretch roller. Specifically, the larger the critical distance—i.e., the longer the film has to travel without being in contact with a pre-stretch roller—the more necking.

Figure 5:
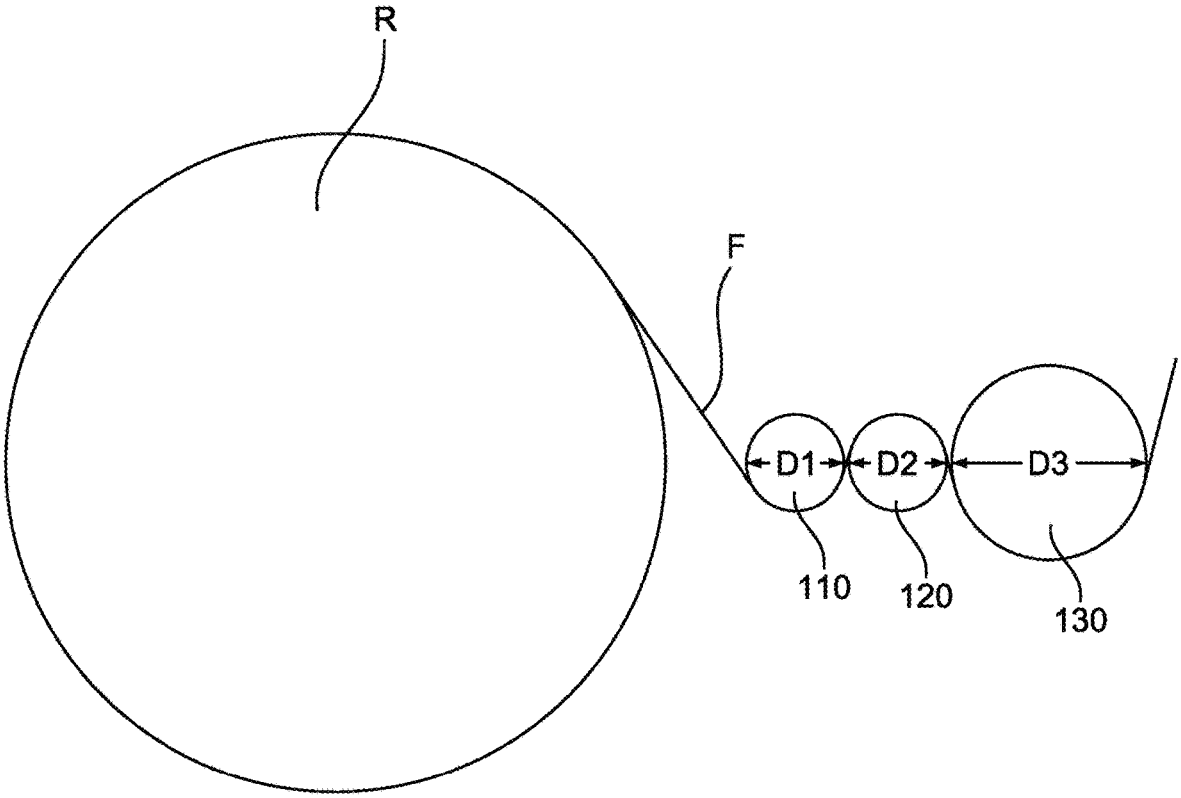
FIG. 5 is a diagrammatic plan view of the film roll and the pre-stretch rollers of the film carriage of FIG. 4.
Figure 5A:
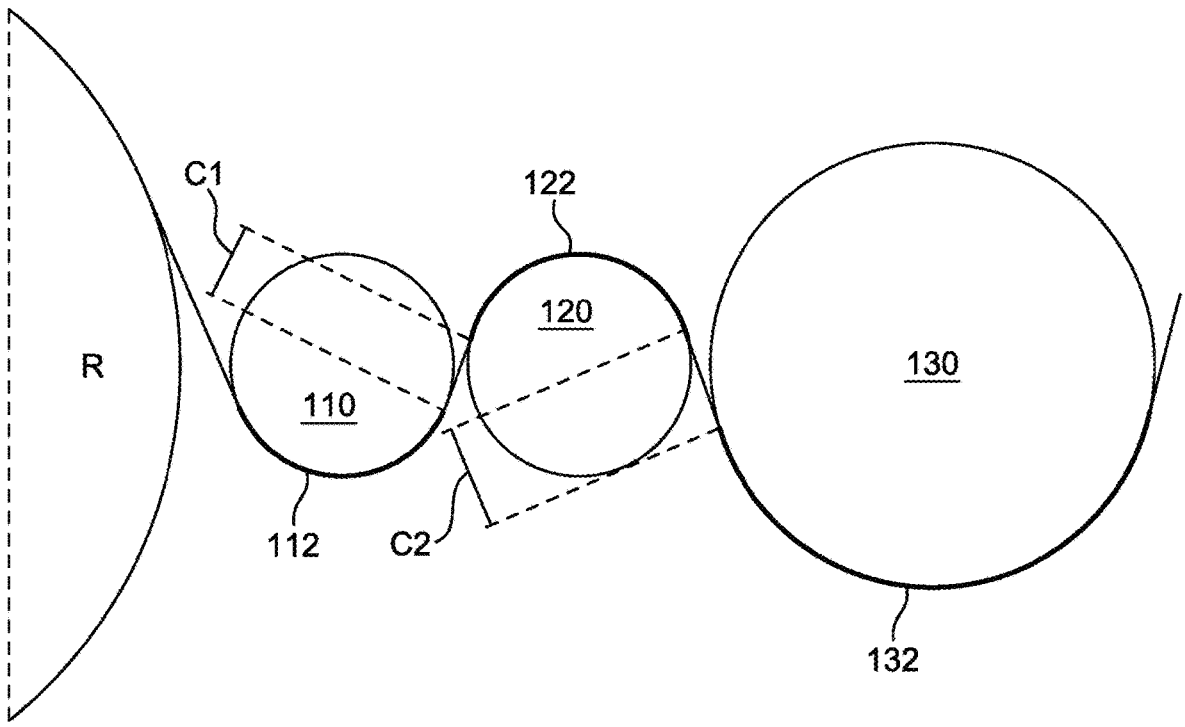
FIG. 5A is an enlarged portion of FIG. 5.

FIG. 5A shows a first critical distance C1 between the first and second pre-stretch rollers 110 and 120 and a second critical distance C2 between the second and third pre-stretch rollers 120 and 130. In this example embodiment, the distance between the surfaces of the first and second pre-stretch rollers 110 and 120 is the same as the distance between the surfaces of the second and third pre-stretch rollers 120 and 130. Accordingly, in this example embodiment, because the third diameter D3 of the third pre-stretch roller 130 is larger than the second diameter D2 of the second pre-stretch roller 120, the second critical distance C2 is larger than the first critical distance C1. In this specific embodiment in which D3 is approximately 2× D2, the critical distance C2 is approximately 30% larger than the first critical distance C1. In alternative embodiments, the diameters and spacing of the pre-stretch rollers can be changed such that the first critical distance C1 is instead larger than the second critical distance C2.

In this example embodiment, the effective surface area of the third pre-stretch roller 130 is greater than (and specifically, approximately 2×) the effective surface areas of each of the first and second pre-stretch rollers 110 and 120. But since the effective surface areas of the first and second pre-stretch rollers 110 and 120—which are both upstream of the third pre-stretch roller 130—are collectively approximately the same as the effective surface area of the third pre-stretch roller 130, the film does not slip during operation. The effective surface area for a roller depends on the diameter of the roller and the alignment of the roller with respect to adjacent rollers. A roller that is out of alignment with adjacent rollers (i.e., the center of the rollers do not form a straight line), can cause more or less of the film to contact the roller, depending on how the film snakes through the rollers.

In operation and as best shown in FIG. 5A (which does not show any idler rollers for clarity), after the film F is pulled off the roll R, the film engages the first pre-stretch roller 110 along its effective surface area 112. The film F then passes through the first critical distance C1 to the second pre-stretch roller 120 and engages along its effective surface area 122. A relatively small amount of stretching of the film F occurs within the first critical distance C1 between the first pre-stretch roller 110 and the second pre-stretch roller 120, and negligible (if any) necking occurs. However, the first and second pre-stretch rollers 110 and 120 provide a combined effective surface area that approximately matches the effective surface area 132 of the third pre-stretch roller 130, thereby minimizing slippage of the film F. As the film F passes through the second critical distance C2 to the third pre-stretch roller 130, the majority of the pre-stretching of the film F occurs within the second critical distance C2. The combination of the two relatively small first and second pre-stretch rollers and the relatively larger third pre-stretch roller provides the desired pre-stretch without slippage and with minimal necking.

The pre-stretch assembly of the present disclosure improves upon the known pre-stretch assembly described above in that it eliminates slippage without sacrificing pre-stretch. It also improves upon a pre-stretch assembly with two relatively large pre-stretch rollers that provide the desired pre-stretch but, due to their relatively large diameters, have a large critical distance and result in significant necking.

The cutting-and-fixing device (not shown) is supported by the wrapping-machine frame 10 and configured to, after the load L has been wrapped, cut the film F at a position between the load L and the wrapping assembly 40 to form a trailing end of the film F and to connect the trailing end of the film F to the wrapped load L to complete the wrapping process. Cutting the film F also creates a leading end of the film F. The cutting-and-fixing device is also configured to hold the leading end after cutting the film F and to connect the leading end of the film F to the next load as it is being wrapped. The cutting-and-fixing device can be any suitable conventional cutting-and-fixing device known in the art.

The wrapping-assembly actuator 400 is operably connected to the wrapping assembly 40 to rotate the wrapping assembly 40 relative to the circular guide 20 and the load L. In certain embodiments, the wrapping-assembly actuator 400 includes one or more motors operably connected to the wrapping assembly 40 via one or more belt-and-pulley assemblies to rotate the wrapping assembly 40 relative to the circular guide 20 and the load L. This is merely an example, and the wrapping-assembly actuator 400 can include any suitable actuator configured to rotate the wrapping assembly 40 relative to the circular guide 20 and the load L.

The operator interface 500 is configured to receive inputs from an operator and, in certain embodiments, to output information to the operator. The operator interface includes one or more input devices configured to receive inputs from the operator. In various embodiments, the one or more input devices include one or more buttons (such as hard or soft keys), one or more switches, and/or a touch panel. In various embodiments, the operator interface 500 includes a display device configured to display information to the operator, such as information about the palletized load, the status of the wrapping operation, or the parameters of the wrapping machine 1 (e.g., the rotational speeds of the pre-stretch rollers). The operator interface can include other output devices instead of or in addition to the display device, such as one or more speakers and/or one or more lights. In certain embodiments, the operator interface 500 is formed as part of the wrapping machine 1 and is, for instance, mounted to the wrapping-machine frame 10. In other embodiments, the operator interface is remote from the wrapping machine 1.

The controller 600 includes a processing device communicatively connected to a memory device. The processing device can include any suitable processing device such as, but not limited to, a general-purpose processor, a special-purpose processor, a digital-signal processor, one or more microprocessors, one or more microprocessors in association with a digital-signal processor core, one or more application-specific integrated circuits, one or more field-programmable gate array circuits, one or more integrated circuits, and/or a state machine. The memory device can include any suitable memory device such as, but not limited to, read-only memory, random-access memory, one or more digital registers, cache memory, one or more semiconductor memory devices, magnetic media such as integrated hard disks and/or removable memory, magneto-optical media, and/or optical media. The memory device stores instructions executable by the processing device to control operation of the wrapping machine 1 (such as to carry out a wrapping operation, as described below).

The controller 600 is communicatively and operably connected to the guide actuator 30, the cutting-and-fixing device, the pre-stretch actuators 150, and the wrapping-assembly actuator 400 to control operation of these components in conjunction with the wrapping operation, as described below. The controller 600 is communicatively connected to the operator interface 500 to: (1) receive signals from the operator interface 500 that represent inputs received by the operator interface 500; and (2) send signals to the operator interface 500 to cause the operator interface 500 to output (such as to display) information.

A wrapping operation in which the wrapping machine 1 is used to wrap the load L with the film F to secure the load L to the pallet P is now partially described. Initially, the circular guide 20 is at its upper position, and the cutting-and-fixing device holds the leading end of the film F. The controller 600 controls the conveyor C to move the load L on the pallet P through the infeed area 10*a* and into the wrapping area of the wrapping machine 1. After the load L on the pallet P reaches the wrapping area, the controller 600 controls the guide actuator 30 to lower the circular guide 20 such that the wrapping assembly 40 is at least partially vertically aligned with part of the load L. The controller 600 controls the cutting-and-fixing device to hold the leading end of the film F against or near the load L while controlling the wrapping-assembly actuator 400 to rotate the wrapping assembly 40 relative to the circular guide 20 and the load L. The rotation of the wrapping assembly 40 relative to the load L combined with the cutting-and-fixing device holding the leading end of the film F against or near the load L causes the film F to be drawn off of the roll R (optionally with the help of one or more motors to feed the film through the wrapping assembly 40), directed through the rollers of the film carriage 100, and wrapped around the load L.

Once the film F has been wrapped around the leading end, the controller 600 controls the cutting-and-fixing device to release the leading end and move away from the load L. The controller 600 continues to control the wrapping-assembly actuator 400 to rotate the wrapping assembly 40 while controlling the guide actuator 30 to vertically move the circular guide 20 such that the load L is wrapped with the film F in a spiral pattern. During wrapping, the controller 600 controls the pre-stretch actuators 150 to rotate the first, second, and third pre-stretch rollers 110, 120, and 130 such that they each have the appropriate linear speeds to pre-stretch the film F as it is drawn through the pre-stretch rollers 110, 120, and 130. After wrapping is complete, the controller 600 controls the cutting-and-fixing device to cut the film F from the roll R and secure the trailing end of the film F to the load L, thereby completing the wrapping operation. The controller 600 controls the conveyor C to move the wrapped load L and pallet P from the wrapping area and through the outfeed area 10*b*.

Various embodiments of the present disclosure thus provide a wrapping machine comprising: a wrapping-machine frame; a guide mounted to the wrapping machine frame; a guide actuator operably connected to the guide to move the guide vertically relative to the wrapping-machine frame; a wrapping assembly mounted to the guide and comprising a film carriage; and a wrapping-assembly actuator operably connected to the wrapping assembly to move the wrapping assembly relative to the guide. The film carriage comprises a film-carriage frame; a first pre-stretch roller rotatably mounted to the film-carriage frame; a second pre-stretch roller rotatably mounted to the film-carriage frame; a third pre-stretch roller rotatably mounted to the film-carriage frame; and a plurality of idler rollers rotatably mounted to the film-carriage frame. The first and second pre-stretch rollers have a first diameter, and the third pre-stretch roller has a greater second diameter. The first, second, and third pre-stretch rollers are controlled to rotate to have different linear speeds such that a minority (e.g., less than 50%, or more specifically between 1-15%) of the stretching of the film occurs between the first and second pre-stretch rollers, and a majority (e.g., more than 50%, or more specifically between 85-99%) of the stretching of the film occurs between the second and third pre-stretch rollers.

Various embodiments of the present disclosure provide the film carriage of the above-described wrapping machine.

The invention claimed is:

1. A film carriage for a wrapping machine, the film carriage comprising:

a film-carriage frame;

a first pre-stretch roller having a first diameter and rotatably mounted to the film-carriage frame;

a second pre-stretch roller having a second diameter and rotatably mounted to the film-carriage frame; and a third pre-stretch roller having a third diameter and rotatably mounted to the film-carriage frame, wherein the third diameter is greater than the first diameter and the second diameter, wherein the first, second, and third pre-stretch rollers are sized and positioned such that an effective surface area of the third pre-stretch roller is no less than the combined effective surface areas of the first pre-stretch roller and the second pre-stretch roller.

2. The film carriage of claim 1, wherein the first diameter and the second diameter are substantially the same.

3. The film carriage of claim 1, wherein the third diameter is at least about twice as large as the second diameter.

4. The film carriage of claim 1, further comprising a pre-stretch drive assembly operably connected to the first pre-stretch roller, the second pre-stretch roller, and the third pre-stretch roller, to rotate the first pre-stretch roller at between 15% and 95% of a linear speed of the third pre-stretch roller.

5. The film carriage of claim 1, further comprising a pre-stretch drive assembly operably connected to the first pre-stretch roller, the second pre-stretch roller, and the third pre-stretch roller to rotate the second pre-stretch roller at between 100% and 150% of the linear speed of the first pre-stretch roller.

6. The film carriage of claim 1, wherein the linear speeds of the first pre-stretch roller, the second pre-stretch roller, and the third pre-stretch roller are controllable such that between 1% and 15% of a total pre-stretching of the film occurs between the first pre-stretch roller and the second pre-stretch roller, and between 85% and 99% of the total pre-stretching of the film occurs between the second pre-stretch roller and the third pre-stretch roller.

7. The film carriage of claim 1, wherein a critical distance between the first pre-stretch roller and the second pre-stretch roller is less than a critical distance between the second pre-stretch roller and the third pre-stretch roller.

8. The film carriage of claim 7, wherein a distance between an outer edge of the first pre-stretch roller and an outer edge of the second pre-stretch roller is the same as a distance between the outer edge of the second pre-stretch roller and an outer edge of the third pre-stretch roller.

9. A wrapping machine comprising:

a wrapping-machine frame;

a guide mounted to the wrapping machine frame;

a guide actuator operably connected to the guide to move the guide vertically relative to the wrapping-machine frame;

a wrapping assembly mounted to the guide and comprising a film carriage, the film carriage comprising:

a film-carriage frame;

a first pre-stretch roller having a first diameter and rotatably mounted to the film-carriage frame;

a second pre-stretch roller having a second diameter and rotatably mounted to the film-carriage frame; and a third pre-stretch roller having a third diameter and rotatably mounted to the film-carriage frame, wherein the third diameter is greater than the first diameter and the second diameter, wherein the first, second, and third pre-stretch rollers are sized and positioned such that an effective surface area of the third pre-stretch roller is no less than the combined effective surface area of the first pre-stretch roller and the second pre-stretch roller; and a wrapping-assembly actuator operably connected to the wrapping assembly to move the wrapping assembly relative to the guide.

10. The wrapping machine of claim 9, wherein the first diameter and the second diameter are substantially the same.

11. The wrapping machine of claim 9, wherein the third diameter roller is at least about twice as large as the second diameter.

12. The wrapping machine of claim 9, further comprising a pre-stretch drive assembly operably connected to the first pre-stretch roller, the second pre-stretch roller, and the third pre-stretch roller, to drive the first pre-stretch roller, the second pre-stretch roller, and the third pre-stretch roller such that a linear speed of the third pre-stretch roller is greater than a linear speed of the second pre-stretch roller, and the linear speed of the second pre-stretch roller is greater than a linear speed of the first pre-stretch roller.

13. The wrapping machine of claim 12, wherein the pre-stretch drive assembly is configured to control the first pre-stretch roller to rotate at between 15% and 95% of the linear speed of the third pre-stretch roller.

14. The wrapping machine of claim 12, wherein the pre-stretch drive assembly is configured to control the second pre-stretch roller to rotate at between 100% and 150% of the linear speed of the first pre-stretch roller.

15. The wrapping machine of claim 12, wherein the pre-stretch drive assembly is configured to control the linear speeds of the first pre-stretch roller, the second pre-stretch roller, and the third pre-stretch roller such that between 1% and 15% of the total stretching of the film occurs between the first pre-stretch roller and the second pre-stretch roller.

16. The wrapping machine of claim 12, wherein the pre-stretch drive assembly is configured to control the linear speeds of the first pre-stretch roller, the second pre-stretch roller, and the third pre-stretch roller such that between 85% and 99% of a total stretching of the film occurs between the second pre-stretch roller and the third pre-stretch roller.

17. The wrapping machine of claim 9, wherein a critical distance between the first pre-stretch roller and the second pre-stretch roller is less than a critical distance between the second pre-stretch roller and the third pre-stretch roller.

18. The wrapping machine of claim 17, wherein a distance between an outer edge of the first pre-stretch roller and an outer edge of the second pre-stretch roller is the same as a distance between the outer edge of the second pre-stretch roller and an outer edge of the third pre-stretch roller.

19. A film carriage for a wrapping machine, the film carriage comprising:

a film-carriage frame;

a first pre-stretch roller having a first diameter and rotatably mounted to the film-carriage frame;

a second pre-stretch roller having a second diameter and rotatably mounted to the film-carriage frame; and a third pre-stretch roller having a third diameter and rotatably mounted to the film-carriage frame, wherein the third diameter is greater than the first diameter and at least about twice as large as the second diameter.

20. A film carriage for a wrapping machine, the film carriage comprising:

a film-carriage frame;

a first pre-stretch roller having a first diameter and rotatably mounted to the film-carriage frame;

a second pre-stretch roller having a second diameter and rotatably mounted to the film-carriage frame;

a third pre-stretch roller having a third diameter and rotatably mounted to the film-carriage frame, wherein the third diameter is greater than the first diameter and the second diameter; and a pre-stretch drive assembly operably connected to the first pre-stretch roller, the second pre-stretch roller, and the third pre-stretch roller to rotate the second pre-stretch roller at between 100% and 150% of the linear speed of the first pre-stretch roller.

21. A film carriage for a wrapping machine, the film carriage comprising:

a film-carriage frame;

a first pre-stretch roller having a first diameter and rotatably mounted to the film-carriage frame;

a second pre-stretch roller having a second diameter and rotatably mounted to the film-carriage frame; and a third pre-stretch roller having a third diameter and rotatably mounted to the film-carriage frame, wherein the third diameter is greater than the first diameter and the second diameter, wherein the linear speeds of the first pre-stretch roller, the second pre-stretch roller, and the third pre-stretch roller are controllable such that between 1% and 15% of a total pre-stretching of the film occurs between the first pre-stretch roller and the second pre-stretch roller, and between 85% and 99% of the total pre-stretching of the film occurs between the second pre-stretch roller and the third pre-stretch roller.

22. A film carriage for a wrapping machine, the film carriage comprising:

a film-carriage frame;

a first pre-stretch roller having a first diameter and rotatably mounted to the film-carriage frame;

a second pre-stretch roller having a second diameter and rotatably mounted to the film-carriage frame; and a third pre-stretch roller having a third diameter and rotatably mounted to the film-carriage frame, wherein the third diameter is greater than the first diameter and the second diameter, wherein a critical distance between the first pre-stretch roller and the second pre-stretch roller is less than a critical distance between the second pre-stretch roller and the third pre-stretch roller.

23. The film carriage of claim 22, wherein a distance between an outer edge of the first pre-stretch roller and an outer edge of the second pre-stretch roller is the same as a distance between the outer edge of the second pre-stretch roller and an outer edge of the third pre-stretch roller.

24. A wrapping machine comprising:

a wrapping-machine frame;

a guide mounted to the wrapping machine frame;

a guide actuator operably connected to the guide to move the guide vertically relative to the wrapping-machine frame;

a wrapping assembly mounted to the guide and comprising a film carriage, the film carriage comprising:

a film-carriage frame;

a first pre-stretch roller having a first diameter and rotatably mounted to the film-carriage frame;

a second pre-stretch roller having a second diameter and rotatably mounted to the film-carriage frame; and a third pre-stretch roller having a third diameter and rotatably mounted to the film-carriage frame, wherein the third diameter is greater than the first diameter and at least about twice as large as the second diameter; and a wrapping-assembly actuator operably connected to the wrapping assembly to move the wrapping assembly relative to the guide.

25. A wrapping machine comprising:

a wrapping-machine frame;

a guide mounted to the wrapping machine frame;

a guide actuator operably connected to the guide to move the guide vertically relative to the wrapping-machine frame;

a wrapping assembly mounted to the guide and comprising a film carriage, the film carriage comprising:

a film-carriage frame;

a first pre-stretch roller having a first diameter and rotatably mounted to the film-carriage frame;

a second pre-stretch roller having a second diameter and rotatably mounted to the film-carriage frame;

a third pre-stretch roller having a third diameter and rotatably mounted to the film-carriage frame, wherein the third diameter is greater than the first diameter and the second diameter; and a pre-stretch drive assembly operably connected to the first pre-stretch roller, the second pre-stretch roller, and the third pre-stretch roller to drive the first pre-stretch roller, the second pre-stretch roller, and the third pre-stretch roller such that a linear speed of the third pre-stretch roller is greater than a linear speed of the second pre-stretch roller and the linear speed of the second pre-stretch roller is greater than a linear speed of the first pre-stretch roller, wherein the pre-stretch drive assembly is configured to control the first pre-stretch roller to rotate at between 15% and 95% of the linear speed of the third pre-stretch roller; and a wrapping-assembly actuator operably connected to the wrapping assembly to move the wrapping assembly relative to the guide.

26. A wrapping machine comprising:

a wrapping-machine frame;

a guide mounted to the wrapping machine frame;

a guide actuator operably connected to the guide to move the guide vertically relative to the wrapping-machine frame;

a wrapping assembly mounted to the guide and comprising a film carriage, the film carriage comprising:

a film-carriage frame;

a first pre-stretch roller having a first diameter and rotatably mounted to the film-carriage frame;

a second pre-stretch roller having a second diameter and rotatably mounted to the film-carriage frame;

a third pre-stretch roller having a third diameter and rotatably mounted to the film-carriage frame, wherein the third diameter is greater than the first diameter and the second diameter; and a pre-stretch drive assembly operably connected to the first pre-stretch roller, the second pre-stretch roller, and the third pre-stretch roller to drive the first pre-stretch roller, the second pre-stretch roller, and the third pre-stretch roller such that a linear speed of the third pre-stretch roller is greater than a linear speed of the second pre-stretch roller and the linear speed of the second pre-stretch roller is greater than a linear speed of the first pre-stretch roller, wherein the pre-stretch drive assembly is configured to control the second pre-stretch roller to rotate at between 100% and 150% of the linear speed of the first pre-stretch roller; and a wrapping-assembly actuator operably connected to the wrapping assembly to move the wrapping assembly relative to the guide.

27. A wrapping machine comprising:

a wrapping-machine frame;

a guide mounted to the wrapping machine frame;

a guide actuator operably connected to the guide to move the guide vertically relative to the wrapping-machine frame;

a wrapping assembly mounted to the guide and comprising a film carriage, the film carriage comprising:

a film-carriage frame;

a first pre-stretch roller having a first diameter and rotatably mounted to the film-carriage frame;

a second pre-stretch roller having a second diameter and rotatably mounted to the film-carriage frame;

a third pre-stretch roller having a third diameter and rotatably mounted to the film-carriage frame, wherein the third diameter is greater than the first diameter and the second diameter; and a pre-stretch drive assembly operably connected to the first pre-stretch roller, the second pre-stretch roller, and the third pre-stretch roller to drive the first pre-stretch roller, the second pre-stretch roller, and the third pre-stretch roller such that a linear speed of the third pre-stretch roller is greater than a linear speed of the second pre-stretch roller and the linear speed of the second pre-stretch roller is greater than a linear speed of the first pre-stretch roller, wherein the pre-stretch drive assembly is configured to control the linear speeds of the first pre-stretch roller, the second pre-stretch roller, and the third pre-stretch roller such that between 1% and 15% of the total stretching of the film occurs between the first pre-stretch roller and the second pre-stretch roller; and a wrapping-assembly actuator operably connected to the wrapping assembly to move the wrapping assembly relative to the guide.

28. A wrapping machine comprising:

a wrapping-machine frame;

a guide mounted to the wrapping machine frame;

a guide actuator operably connected to the guide to move the guide vertically relative to the wrapping-machine frame;

a wrapping assembly mounted to the guide and comprising a film carriage, the film carriage comprising:

a film-carriage frame;

a first pre-stretch roller having a first diameter and rotatably mounted to the film-carriage frame;

a second pre-stretch roller having a second diameter and rotatably mounted to the film-carriage frame;

a third pre-stretch roller having a third diameter and rotatably mounted to the film-carriage frame, wherein the third diameter is greater than the first diameter and the second diameter; and a pre-stretch drive assembly operably connected to the first pre-stretch roller, the second pre-stretch roller, and the third pre-stretch roller to drive the first pre-stretch roller, the second pre-stretch roller, and the third pre-stretch roller such that a linear speed of the third pre-stretch roller is greater than a linear speed of the second pre-stretch roller and the linear speed of the second pre-stretch roller is greater than a linear speed of the first pre-stretch roller, wherein the pre-stretch drive assembly is configured to control the linear speeds of the first pre-stretch roller, the second pre-stretch roller, and the third pre-stretch roller such that between 85% and 99% of a total stretching of the film occurs between the second pre-stretch roller and the third pre-stretch roller; and a wrapping-assembly actuator operably connected to the wrapping assembly to move the wrapping assembly relative to the guide.

29. A wrapping machine comprising:

a wrapping-machine frame;

a guide mounted to the wrapping machine frame;

a guide actuator operably connected to the guide to move the guide vertically relative to the wrapping-machine frame;

a wrapping assembly mounted to the guide and comprising a film carriage, the film carriage comprising:

a film-carriage frame;

a first pre-stretch roller having a first diameter and rotatably mounted to the film-carriage frame;

a second pre-stretch roller having a second diameter and rotatably mounted to the film-carriage frame; and a third pre-stretch roller having a third diameter and rotatably mounted to the film-carriage frame, wherein the third diameter is greater than the first diameter and the second diameter, wherein a critical distance between the first pre-stretch roller and the second pre-stretch roller is less than a critical distance between the second pre-stretch roller and the third pre-stretch roller; and a wrapping-assembly actuator operably connected to the wrapping assembly to move the wrapping assembly relative to the guide.

30. The wrapping machine of claim 29, wherein a distance between an outer edge of the first pre-stretch roller and an outer edge of the second pre-stretch roller is the same as a distance between the outer edge of the second pre-stretch roller and an outer edge of the third pre-stretch roller.

* * * * *